US011266891B2

(12) United States Patent
Johnson

(10) Patent No.: US 11,266,891 B2
(45) Date of Patent: Mar. 8, 2022

(54) TARGET FOR SPORT GOAL

(71) Applicant: Benjamin Adam Johnson, Weymouth, MA (US)

(72) Inventor: Benjamin Adam Johnson, Weymouth, MA (US)

(73) Assignee: EpicSportsLLC, Weymouth, MA (US)

( * ) Notice: Subject to any disclaimer, the term of this patent is extended or adjusted under 35 U.S.C. 154(b) by 0 days.

(21) Appl. No.: 17/072,634

(22) Filed: Oct. 16, 2020

(65) Prior Publication Data

US 2021/0113900 A1 Apr. 22, 2021

Related U.S. Application Data

(60) Provisional application No. 62/915,845, filed on Oct. 16, 2019.

(51) Int. Cl.

| | |
|---|---|
| ***A63B 63/06*** | (2006.01) |
| ***A63B 69/00*** | (2006.01) |
| ***A63B 63/00*** | (2006.01) |
| *A63B 71/06* | (2006.01) |

(52) U.S. Cl.

CPC ..... *A63B 63/004* (2013.01); *A63B 63/003* (2013.01); *A63B 63/06* (2013.01); *A63B 69/0026* (2013.01); *A63B 69/002* (2013.01); *A63B 2071/0602* (2013.01); *A63B 2071/0625* (2013.01)

(58) Field of Classification Search

CPC ..... A63B 63/00; A63B 63/002; A63B 63/0024–0026; A63B 63/003; A63B 63/004; A63B 63/06; A63B 69/002; A63B 69/0024–0026

See application file for complete search history.

(56) References Cited

U.S. PATENT DOCUMENTS

| | | | | |
|---|---|---|---|---|
| 3,680,862 | A | 8/1972 | Russell et al. | |
| 4,245,843 | A * | 1/1981 | Griggs | A63B 63/00 273/380 |
| 4,295,648 | A * | 10/1981 | Stromback | A63B 63/00 273/402 |
| 4,842,283 | A * | 6/1989 | LeBel | A63B 63/004 273/392 |
| 5,181,725 | A | 1/1993 | Leras et al. | |
| 5,628,515 | A | 5/1997 | Levy | |
| 6,402,641 | B1 | 6/2002 | Lee | |
| 7,134,976 | B1 | 11/2006 | Smith | |
| 7,252,604 | B2 | 8/2007 | Birss | |
| 7,407,452 | B1 | 8/2008 | Gawthrop | |

(Continued)

*Primary Examiner* — Laura Davison

(74) *Attorney, Agent, or Firm* — Dunlap Bennett & Ludwig, PLLC; Brendan E. Squire

(57) ABSTRACT

A target for sport goal is configured to attach to a cross member of a goal, such as a hockey goal, a soccer goal, lacrosse goal, and other such goals. The target includes a sleeve member that has an interior radius corresponding to that of the intended goal to which it is mounted. Attachment slots receive an attachment strap to secure the sleeve to the cross member. Suspension slots are disposed to receive a suspension strap that secures a target in a desired orientation relative to the length of the sleeve. The target is configured such that the target provides an audible or visual indication when the target is struck by a game object, such as a puck, a ball, or the like.

11 Claims, 6 Drawing Sheets

(56) References Cited

U.S. PATENT DOCUMENTS

| | | | | |
|---|---|---|---|---|
| 7,661,679 | B2 * | 2/2010 | Mah | A63F 7/0604 273/371 |
| 8,052,545 | B1 * | 11/2011 | Assenheimer, III | A63B 63/003 473/446 |
| 8,109,845 | B2 | 2/2012 | Duty | |
| 8,187,123 | B2 | 5/2012 | Pettys et al. | |
| 8,844,934 | B2 * | 9/2014 | Dean | F41J 1/10 273/407 |
| 9,694,266 | B2 * | 7/2017 | Marcin | A63B 63/004 |
| 10,159,883 | B2 | 12/2018 | Roach et al. | |
| 2008/0214331 | A1 | 9/2008 | Talafous et al. | |
| 2009/0176603 | A1 | 7/2009 | Prince | |
| 2015/0273296 | A1 * | 10/2015 | Marcin | A63B 63/003 473/446 |
| 2016/0107057 | A1 | 4/2016 | Wisegarver | |
| 2017/0113116 | A1 | 4/2017 | Cygan et al. | |
| 2017/0239545 | A1 | 8/2017 | Herbst | |

* cited by examiner

TARGET FOR SPORT GOAL

CROSS-REFERENCE TO RELATED APPLICATION

This application claims the benefit of priority of U.S. provisional application No. 62/915,845 filed Oct. 16, 2019, the contents of which are herein incorporated by reference.

BACKGROUND OF THE INVENTION

The present invention relates to goal sports, and more particularly to a target for sports goals.

With an empty sports net, such as hockey, soccer, lacrosse, and the like, it is difficult to verify that the athlete's shooting accuracy is improving when they are taking a shot on goal. Other goal target devices either detach when struck or continue to swing when connected to the net and struck by the puck, ball, or other game object. This is inconsistent during team practices where shots come in succession.

As can be seen, there is a need for an improved goal target that is durable and secured into place, with a minimal residual swing.

SUMMARY OF THE INVENTION

In one aspect of the present invention, a target for sport goal is disclosed. The target for sport goal includes a mounting sleeve having an arcuate inner face that is dimensioned to receive a cross bar for a sport goal. A plurality of attachment slots are provided at opposed ends of the mounting sleeve. A plurality of target suspension slots are also defined in the mounting sleeve. An attachment strap is received through the plurality of attachment slots and is configured to secure the mounting sleeve to a cross bar of the sport goal. A target suspension strap is received in the plurality of target suspension slot and a target having a transverse slot defined through a face of the target. The target suspension strap is received through the transverse slot to suspend the target from the mounting sleeve.

In some embodiments, a tab is disposed at an end of the target suspension strap; wherein in a folded condition, the tab is received through one of the plurality of target suspension slots, and in an unfolded condition, the tab retains the end of the target suspension strap in the one of the plurality of suspension slots.

In other embodiments, a hole is defined in an end of the target suspension strap. An aperture is defined in the mounting sleeve. The hole is disposed between the plurality of target suspension slots. A fastener is received through each of the hole and the aperture to secure the target suspension strap to the mounting sleeve.

In some embodiments the plurality of attachment slots are disposed in a spaced apart relation about an arch of the arcuate inner face.

In some embodiments, the plurality of target suspension slots are disposed in a spaced apart relation about an arch of the arcuate inner face, such that the target suspension strap is suspended from the mounting sleeve in a substantially V-shape and the transverse slot of the target is suspended from a base of the V-shape.

In some embodiments, a cooperating fastener is disposed at opposed ends of the attachment strap. The cooperating fastener is configured to secure the mounting sleeve to the crossbar.

In some embodiments, a plurality of targets are disposed in a spaced apart relation along a longitudinal length of the mounting sleeve. Each of the plurality of targets are attached to the mounting sleeve via the target suspension strap.

In some embodiments, the target is configured to produce a sound when struck by the game object. The target may be metallic.

In yet other embodiments, the game object is a hockey puck.

These and other features, aspects and advantages of the present invention will become better understood with reference to the following drawings, description and claims.

DETAILED DESCRIPTION

Figure 1:
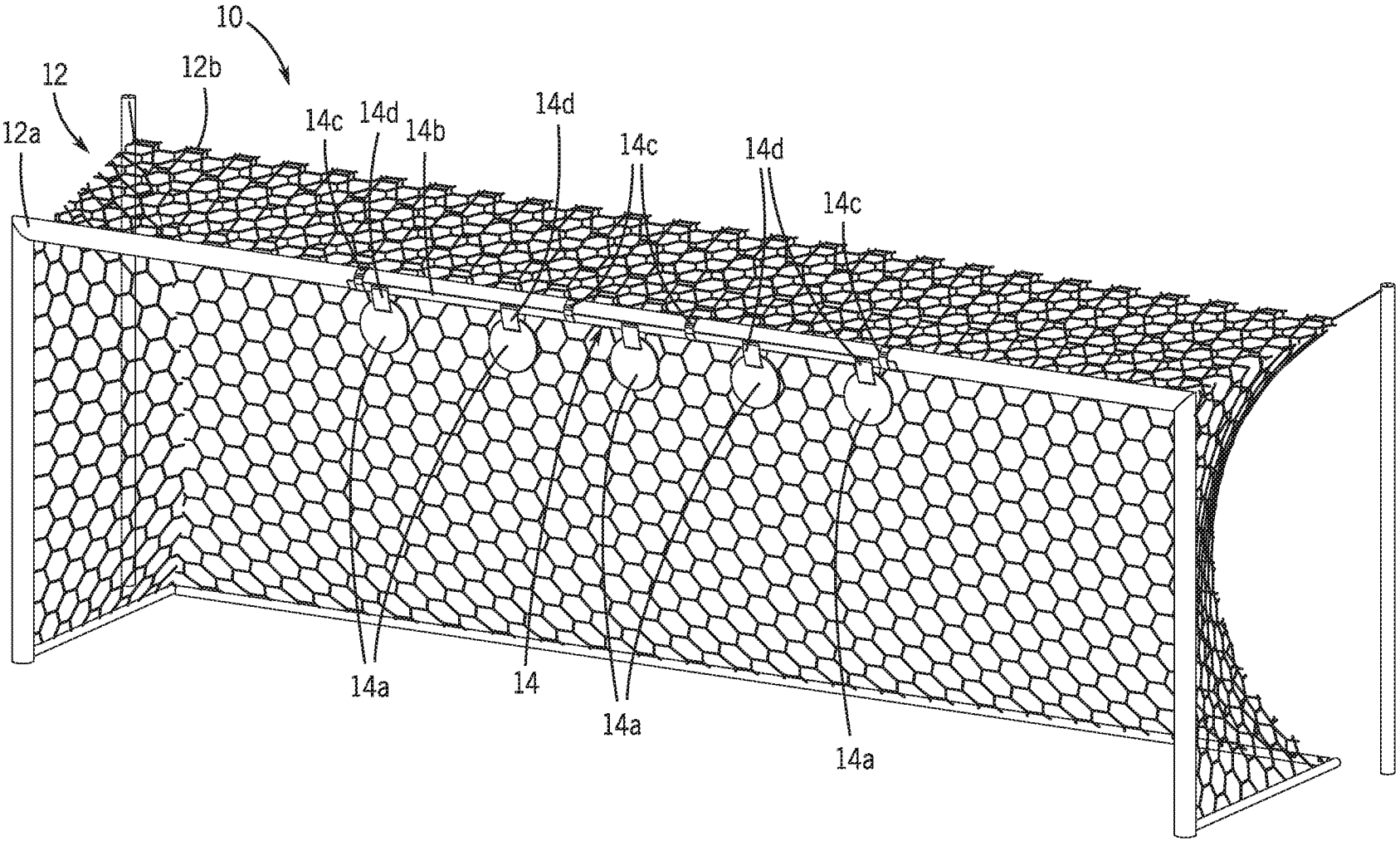
FIG. 1 is a perspective view of the target for sport goal shown in use.
Figure 2:
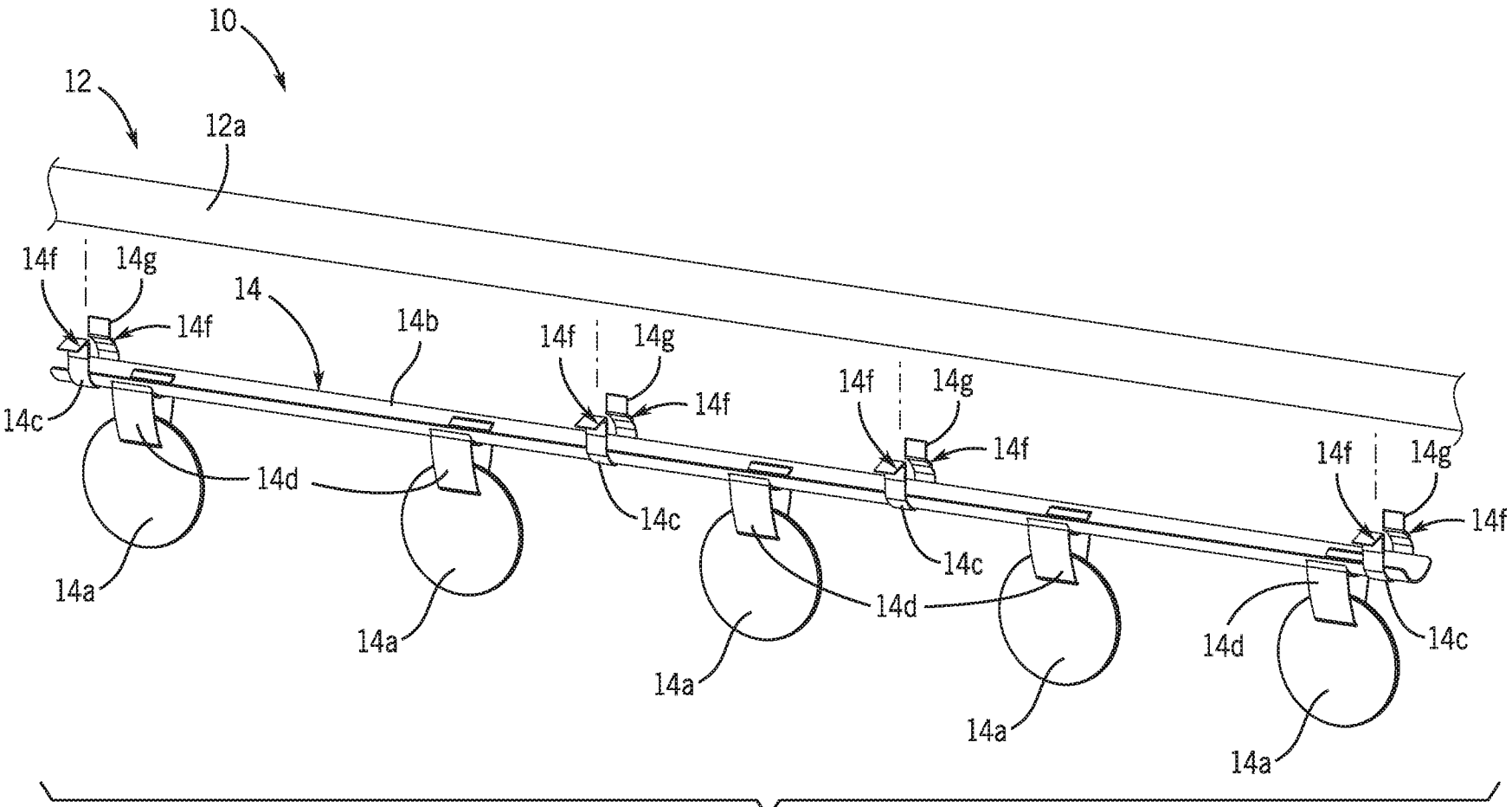
FIG. 2 is an exploded perspective view of the target for sport goal in use.
Figure 3:
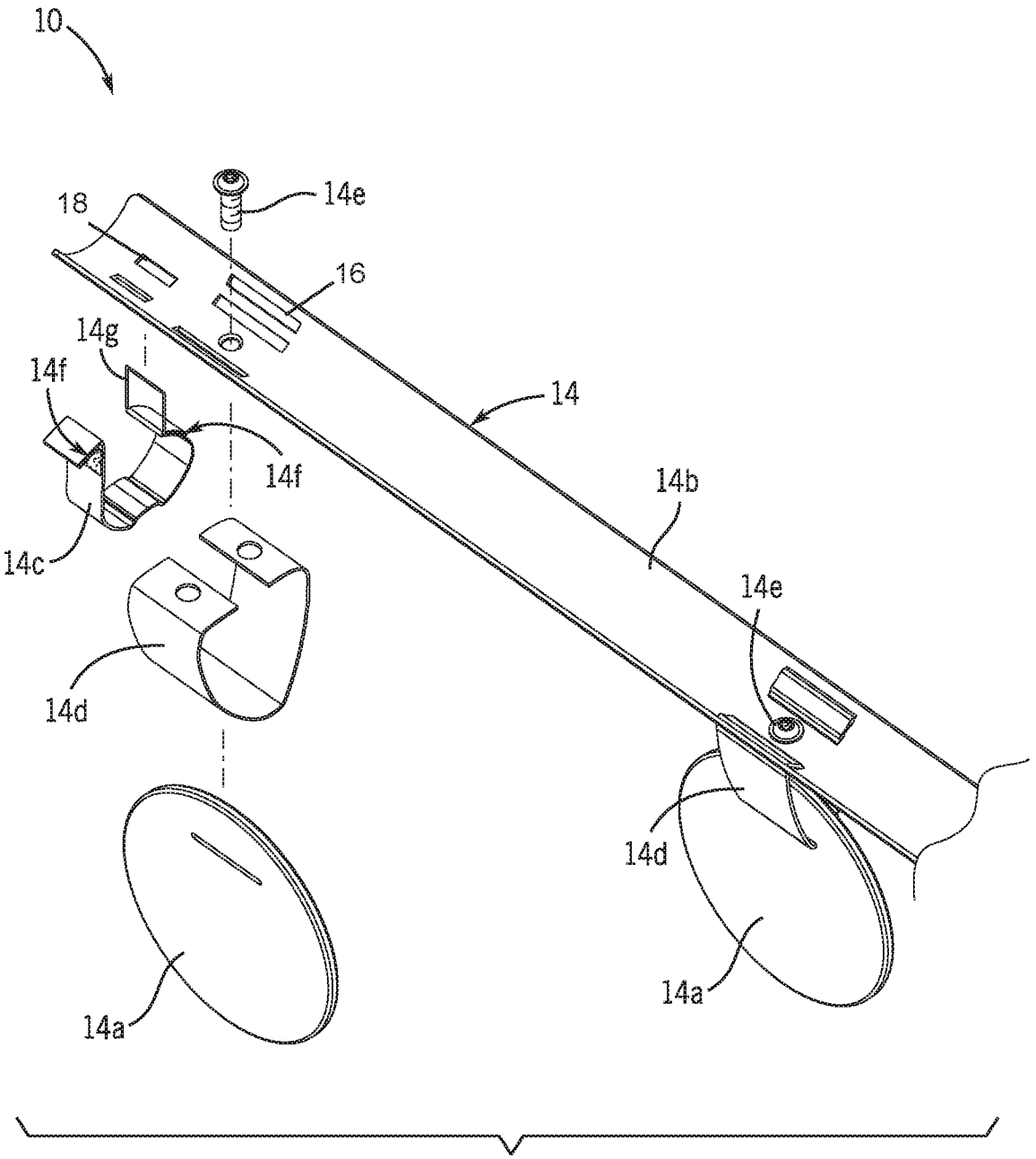
FIG. 3 is a detail exploded perspective view of the target for sport goal.
Figure 4:
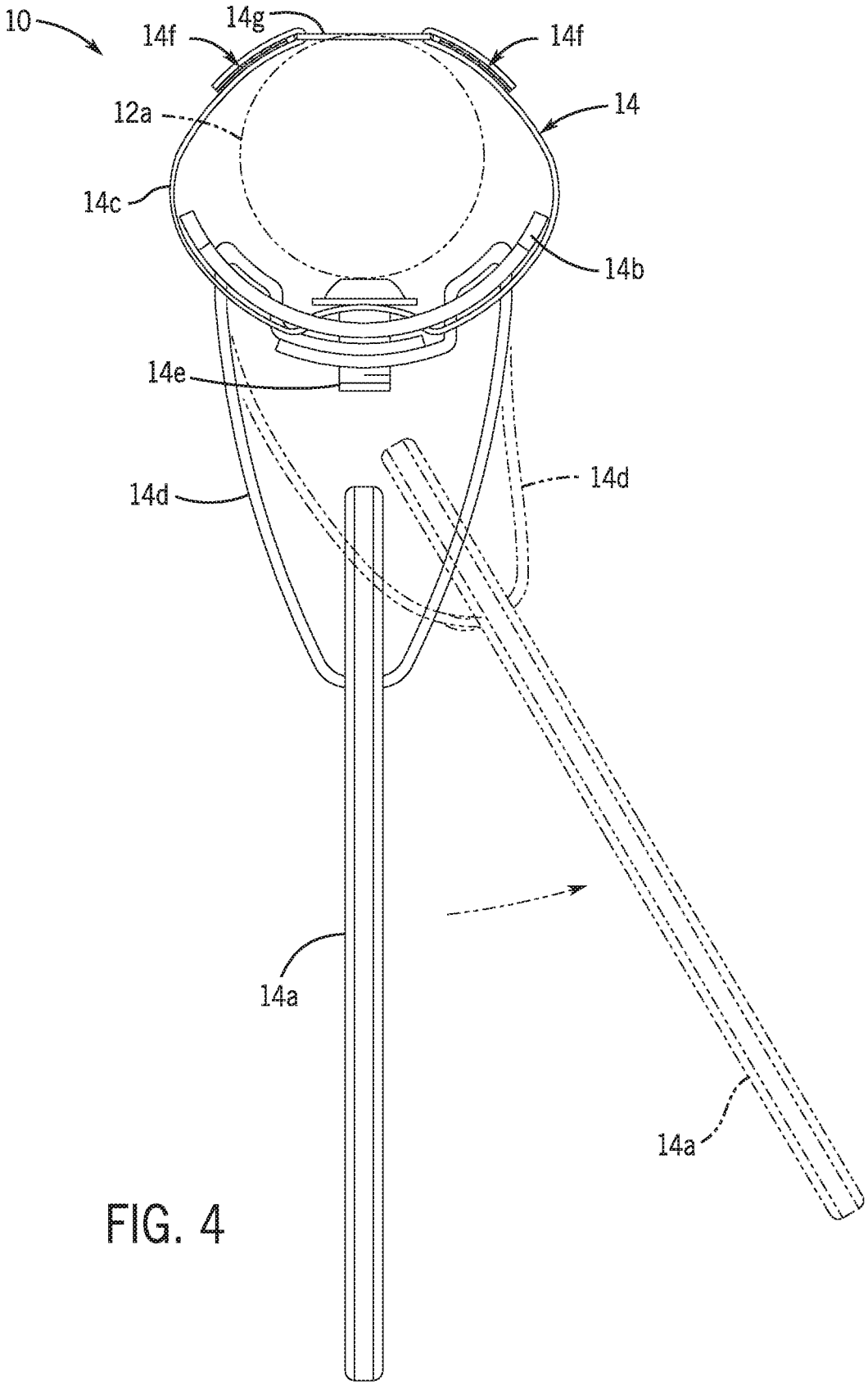
FIG. 4 is a right elevation view of the target for sport goal.

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides an improved target for training and competition in goal type sports, that indicates the strike effect of a game object, such as a puck or ball, against the target, but then snaps back into position for the next shooter or a subsequent shot on goal. The target is suspended from a cross bar 12*a* of the goal 12. The target device 10 can also be suspended from inserts for securing a net 12*b* to a goal 12 with a horizontal cross bar 12*a*.

As indicated previously, with an empty sports net 12, one cannot verify that a player's shooting accuracy is improving. During a practice session, it is important that team players keep moving and each player needs to see the same shot opportunity to provide the same level of instruction. The existing devices take too long to deploy or reset and are inconsistent when struck.

The target device 10 of the present invention attaches to a goal 12 cross bar 12*a* with one or more attachment straps 14*c*. A target 14*a* designed to reset its position after being struck hangs from a mounting sleeve 14*b* of the target device 10. Mounting the target 14*a* to a target suspension strap 14*d* prior to attaching the target 14*a* to the net 12 allows for consistency and control over the behavior the target 14*a* when it is struck by the game object.

As seen in reference to the drawings of FIGS. 1-6, the target device 10 includes the mounting sleeve 14*b* that has an arcuate inner face that is dimensioned to receive a cross bar 12*a* for a sport goal 12. The mounting sleeve 14*b* includes attachment slots 18 defined at ends thereof to receive the attachment strap 14*c* for securing the mounting sleeve 14*b* to the cross bar 12*a*. The mounting sleeve 14*b* also includes a plurality of target suspension slots 16, preferably disposed between the attachment slots 18.

A target suspension strap 14*d* secures a target 14*a* to the mounting sleeve 14*b* in a suspended orientation beneath and substantially aligned with the mounting sleeve 14*b* and a face of the goal 12 opening. The target suspension strap 14*d* is preferably a durable semi-rigid material to maintain and restore the target 14*a* in its suspended position beneath the mounting sleeve 14*b*, yet allows the target 14*a* to respond in a deflection, and thereby indicate a striking of the target 14*a* by the game object, providing a visual indication that the player has hit an intended target 14*a* with the game object. The target suspension strap 14*d* may also include an aperture and a grommet that is secured via a fastener 14*e*, such as a bolt, rivet, or screw to secure the target suspension strap to the sleeve. Alternatively, the target suspension strap 14*d* may have tabs defined at ends thereof, wherein in a folded condition the tab extends through the target suspension slot 16 and in an unfolded condition the tab is retained in the target suspension slot 16.

The mounting sleeve 14*b* is placed onto a goal crossbar 12*a* frame member with the attachment straps 14*c* securing the target device 10 to the goal. The target suspension strap 14*d* is secured to both the mounting sleeve 14*b* and the target 14*a*. The target 14*a* may be weighted to facilitate a rapid return to the ready position. The displacement of the target suspension slots 16 about an arch of the arcuate face of the mounting sleeve 14*b* spreads the ends of the target suspension strap 14*d*, such that the target 14*a* is suspended with the target suspension strap 14*d* then formed in a V-shape. The fastener 14*e* is positioned between opposed ends of the suspension strap 14*d* provides shielding for the fastener 14*e* from being struck by the game object. The width of the suspension strap with the weight of the target 14*d* within the V-shape uses gravity to return the target 14*a* to its original position after being struck.

Figure 5:
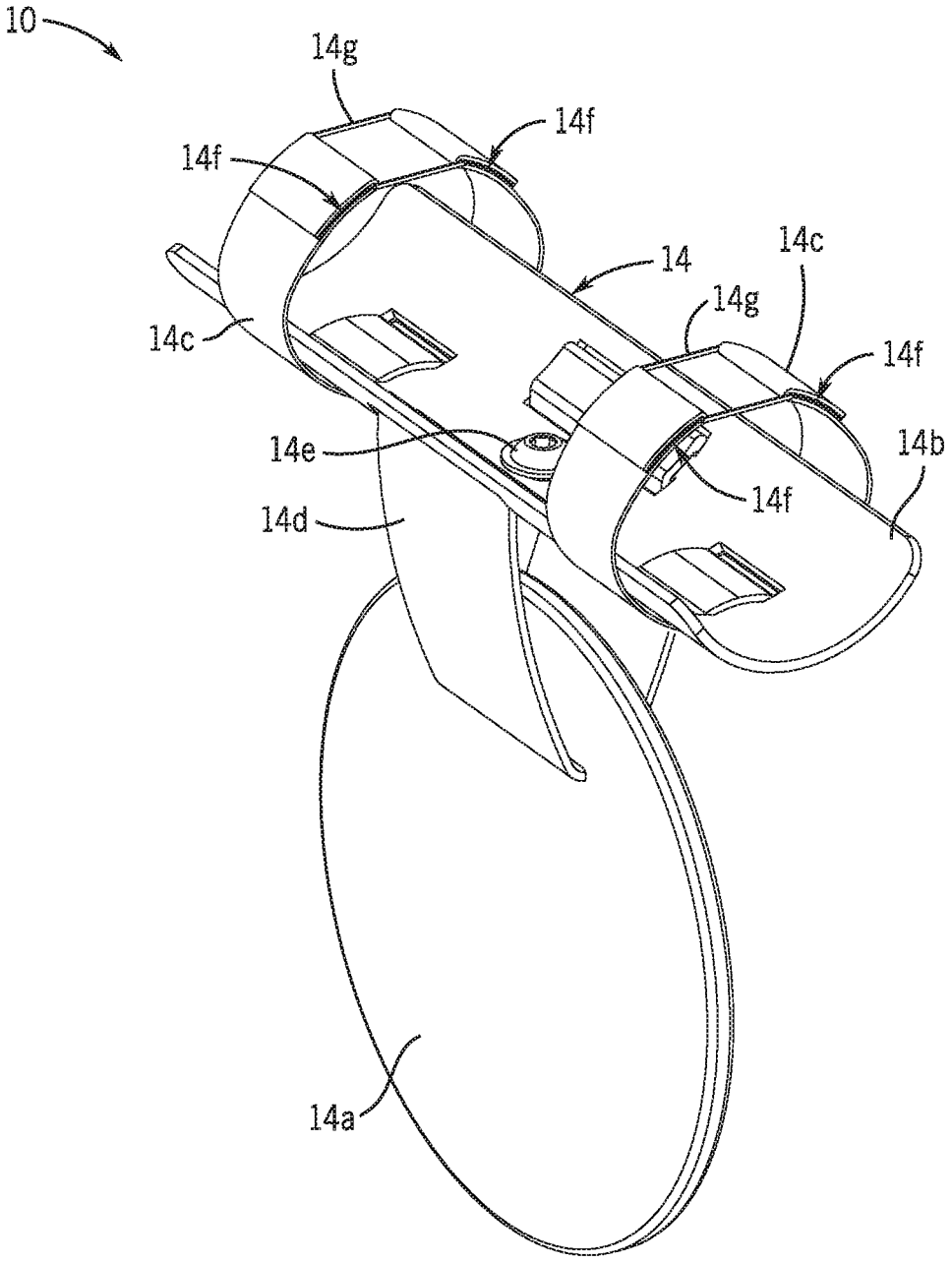
FIG. 5 is a perspective view of the target for sport goal shown in an alternate configuration.
Figure 6:
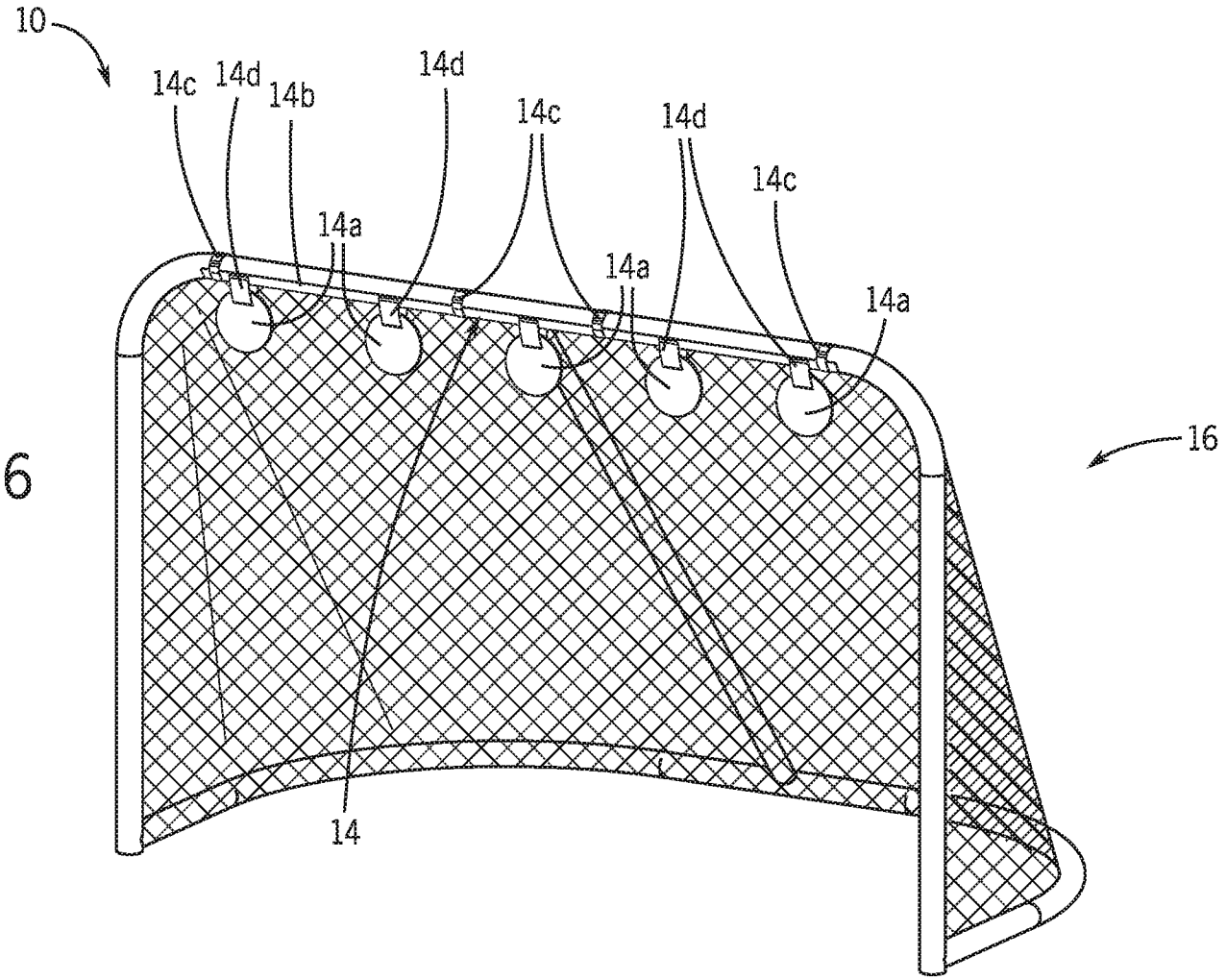
FIG. 6 is a perspective view of the target for sport goal in use with a hockey net.

In the non-limiting embodiment shown in reference to FIG. 5, a single target device 10 is shown. In the non-limiting embodiment shown in reference to FIGS. 1-3, a plurality of targets 14*a* may be suspended from an elongate mounting sleeve 14*b* having a plurality of target suspension slots 16 disposed in a spaced apart relation along a longitudinal length of the mounting sleeve 14*b*. A target 14*a* may be selectively attached to each or a selected number of suspension slots 16 to present a desired target 14*a* grouping.

In use, a coach may designate a target 14*a*, or sequence of targets 14*a* for the player(s) to aim at while taking a shot on goal. When the player is successful, the coach and player are provided with a visual indication of a successfully aimed shot. In goal sports such as hockey, given the speed of the puck, it can be difficult to determine a precise placement of a shot on goal. With the target(s) 14*a* of the present invention, the displacement and sound of the puck against the target 14*a* provide one or more of a visual and audible indication of a successfully aimed shot. As will be appreciated, the target 14*a* may be sized based on the sport, the size of the game object, the skill level of the players, and the level of difficulty the coach may want to provide.

In other uses, the target device 10 of the present invention may also be utilized as a competitive game. Players may then compete based on the number of accurately placed shots in a specified sequence, such as left to right, right to left, or other sequential designation of aiming and striking of the targets 14*a*.

The weighted target 14*a*, target suspension strap 14*d* and elongated transverse slot resets the target to a forward still position quickly using gravity. This eliminates the need for any type of mechanical or electronic resetting mechanism. The target device 10 of the present invention has no hinges, arms, brackets or clamps to hold the target in place. This simplifies the design which significantly improves its durability.

It should be understood, of course, that the foregoing relates to exemplary embodiments of the invention and that modifications may be made without departing from the spirit and scope of the invention as set forth in the following claims.

What is claimed is:

1. A target device for a sport goal, comprising:

a mounting sleeve has an arcuate inner face that is dimensioned to receive a cross bar for a sport goal, a plurality of attachment slots are provided at opposed ends of the mounting sleeve, and a plurality of target suspension slots are defined in the mounting sleeve;

an attachment strap is received through the plurality of attachment slots and is configured to secure the mounting sleeve to a cross bar of the sport goal;

a target suspension strap received in the plurality of target suspension slots; and a target having a transverse slot defined through a face of the target, the target suspension strap received through the transverse slot to suspend the target from the mounting sleeve.

2. The target device of claim 1, further comprising:

a tab disposed at an end of the target suspension strap; wherein in a folded condition, the tab is received through one of the plurality of target suspension slots; and in an unfolded condition, the tab retains the end of the target suspension strap in the one of the plurality of target suspension slots.

3. The target device of claim 1, further comprising:

a hole defined in an end of the target suspension strap; and an aperture defined in the mounting sleeve, the hole disposed between the plurality of target suspension slots; and a fastener received through each of the hole and the aperture to secure the target suspension strap to the mounting sleeve.

4. The target device of claim 1, wherein the plurality of attachment slots are disposed in a spaced apart relation about an arch of the arcuate inner face.

5. The target device of claim 1, wherein the plurality of target suspension slots are disposed in a spaced apart relation about an arch of the arcuate inner face, such that the target suspension strap is suspended from the mounting sleeve in a substantially V-shape and the transverse slot of the target is suspended from a base of the V-shape.

6. The target device of claim 1, further comprising:

a cooperating fastener disposed at opposed ends of the attachment strap; the cooperating fastener configured to secure the mounting sleeve to the cross bar.

7. The target device of claim 1, further comprising:

a plurality of targets disposed in a spaced apart relation along a longitudinal length of the mounting sleeve;

a plurality of target suspension straps, wherein each of the plurality of targets are attached to the mounting sleeve via one the plurality of target suspension straps.

8. The target device of claim 1, wherein the target is configured to indicate a strike effect of a game object against the target.

9. The target device of claim 8, wherein the target is metallic.

10. The target device of claim 9, wherein the game object is a hockey puck.

11. The target device of claim 9, wherein the target is configured to produce a sound when struck by the game object.

* * * * *